US010422182B2

(12) United States Patent
Miller

(10) Patent No.: US 10,422,182 B2
(45) Date of Patent: Sep. 24, 2019

(54) UNITIZED STRUCTURAL FRAME

(71) Applicant: Qualitas Manufacturing, Inc., Itasca, IL (US)

(72) Inventor: James V. Miller, Glen Ellyn, IL (US)

(73) Assignee: Qualitas Manufacturing, Inc., Itasca, IL (US)

( * ) Notice: Subject to any disclaimer, the term of this patent is extended or adjusted under 35 U.S.C. 154(b) by 0 days.

(21) Appl. No.: 14/182,219

(22) Filed: Feb. 17, 2014

(65) Prior Publication Data

US 2014/0231029 A1 Aug. 21, 2014

Related U.S. Application Data

(60) Division of application No. 11/781,741, filed on Jul. 23, 2007, now abandoned, which is a continuation-in-part of application No. 11/459,577, filed on Jul. 24, 2006, now abandoned.

(51) Int. Cl.

| | |
|---|---|
| ***E06B 9/58*** | (2006.01) |
| ***E06B 9/86*** | (2006.01) |
| *E06B 9/00* | (2006.01) |

(52) U.S. Cl.

CPC ..... *E06B 9/86* (2013.01); *E06B 9/581* (2013.01); *E06B 2009/005* (2013.01); *E06B 2009/587* (2013.01)

(58) Field of Classification Search

CPC ..... E06B 2009/587; E06B 2009/005; E06B 9/58; E06B 9/581; E06B 9/86

USPC ..... 160/31, 98, 183; 52/203, 202

See application file for complete search history.

(56) References Cited

U.S. PATENT DOCUMENTS

| | | | | |
|---|---|---|---|---|
| 1,745,208 | A * | 1/1930 | Dixson | 160/31 |
| 1,918,415 | A | 7/1933 | Miller | |
| 2,449,264 | A | 9/1948 | Wilkinson | |
| 2,956,315 | A | 10/1960 | Lipp et al. | |
| 3,269,455 | A | 8/1966 | Gillotti | |
| 3,668,808 | A | 6/1972 | Perina | |
| 4,068,428 | A | 1/1978 | Peterson, III | |

(Continued)

*Primary Examiner* — Katherine W Mitchell
*Assistant Examiner* — Jeremy C Ramsey
(74) *Attorney, Agent, or Firm* — Miller, Matthias & Hull LLP

(57) ABSTRACT

An improvement in a rolling shutter assembly for covering an opening of a structure defined by a top wall, a bottom wall and oppositely disposed side walls. The rolling shutter assembly includes a shutter housing, a shutter support member rotatably disposed within the shutter housing, a shutter coupled to the shutter support member, the shutter comprising a plurality of individual slats and a plurality of hinges interconnecting the slats, and a pair of side tracks. The shutter rolls between a rolled position wherein the shutter is rolled onto the shutter support member and an unrolled position wherein the shutter covers the opening and the ends of the slats are disposed within the channels of the corresponding side tracks. The improvement comprises a support frame having top, bottom and side rails mounted to the walls defining the opening with the side tracks each mounted to a corresponding one of the side rails of the support frame. The support frame reduces or eliminates the transmission of torsion loads from the shutter to the framing elements of the walls during positive and negative pressure conditions.

24 Claims, 12 Drawing Sheets

(56) References Cited

U.S. PATENT DOCUMENTS 4,193,235 A * 3/1980 Cucchiara ..... E06B 3/285 160/380
4,377,915 A 3/1983 Zossimas et al.
4,567,805 A 2/1986 Glevinger
4,915,152 A 4/1990 Magee
5,575,322 A 11/1996 Miller
5,623,783 A 4/1997 Kenkel
5,657,805 A 8/1997 Magro
5,720,137 A 2/1998 Rodriquez
5,740,639 A * 4/1998 Covington ..... E06B 9/02 49/463
5,850,862 A 12/1998 Miller
5,938,136 A 8/1999 Miller
5,941,031 A * 8/1999 Fullwood ..... E06B 3/00 52/202
5,975,185 A 11/1999 Miller et al.
5,983,971 A 11/1999 Miller et al.
5,996,669 A 12/1999 Miller
6,012,260 A 1/2000 Hendrick et al.
6,021,837 A 2/2000 Miller
6,085,822 A 7/2000 Miller
6,095,224 A 8/2000 Miller
6,095,225 A 8/2000 Miller
6,244,325 B1 6/2001 Miller et al.
6,263,942 B1 7/2001 Miller
6,302,179 B1 10/2001 Miller
6,314,689 B1 * 11/2001 Hughes ..... E06B 5/10 52/203
6,374,551 B1 4/2002 Boilen et al.
6,422,289 B1 7/2002 Miller
6,453,975 B2 9/2002 Miller
6,655,444 B2 12/2003 Goldenberg et al.
6,666,251 B2 * 12/2003 Ikle ..... 160/120
6,851,464 B2 2/2005 Hudoba et al.
7,413,000 B2 8/2008 Lin
2002/0108325 A1 8/2002 Hulls
2004/0035056 A1 * 2/2004 Briscoe et al. ..... 49/67
2005/0082020 A1 4/2005 Miller
2005/0205221 A1 9/2005 Miller
2005/0205222 A1 9/2005 Miller
2005/0205223 A1 9/2005 Miller
2006/0118251 A1 6/2006 Miller
2007/0028536 A1 2/2007 Pandorf
2007/0056696 A1 3/2007 Lin
2007/0175603 A1 8/2007 Lin

* cited by examiner

UNITIZED STRUCTURAL FRAME

REFERENCE TO RELATED APPLICATION

This application is a divisional of U.S. Ser. No. 11/781,741, filed on Jul. 23, 2007, which is a continuation-in-part of U.S. Ser. No. 11/459,577, filed on Jul. 24, 2006, which both applications are expressly incorporated by reference herein.

BACKGROUND

The patent is directed to shutters, and more particularly to a rolling protective shutter having a unitized structural frame for mounting the shutter to the structure surrounding and defining an opening to be covered by the shutter curtain, and for reinforcing the side rails and the structural framing of the opening.

Hurricane protection is desired more and more by business owners, home owners and municipalities, and the engineering and testing requirements for such protection are becoming increasingly stringent and rigorous. Many different solutions have been implemented in the attempt to protect structures from the varying forces and conditions associated with hurricanes. For example, openings for windows, doorways, porches and the like require protection from the forces created by the severe winds associated with the hurricanes that cause positive pressure pressing against the openings on the windward side of the structure, and negative pressure pulling outwardly from the opening on the leeward side of the structure.

One attempted solution for protecting openings is the installation of panels attached to the surrounding support structure of the building defining the opening such that the opening is essentially isolated from the surrounding environment. FIG. 1 illustrates an example of a panel 10 configured to cover an opening 12 defined by the surrounding structure 14 and having a window 16 disposed therein. The panel 10 has a plurality of openings 18 around the perimeter of the panel 10 configured to receive fasteners that will anchor the panel 10 to the surrounding structure 14 on the both sides and above and below the opening 12.

The panel 10 may be fabricated from any desired material that may withstand the conditions present during the hurricane, such as metal, plywood, fabric and the like. FIG. 2 schematically illustrates the reaction of the panel 10 fabricated from a rigid material mounted over the opening 12 by fasteners 20 and subjected to a force $F_{NP}$ resulting from the negative pressure caused by high winds during a hurricane. Because the panel is rigid, the panel does not deflect in response to the negative pressure, and the force $F_{NP}$ is distributed relatively evenly to the fasteners 20 and support structure on all four sides of the panel 10 and opening 12. The fasteners 20 primarily experience tensile loads that may be accounted for with adequate numbers and sizes of fasteners 20. FIG. 3 schematically illustrates a flexible panel 10 covering the opening 12 and subjected to the force $F_{NP}$ resulting from the negative pressure. As with the rigid panel 10, the fasteners 20 are placed in tension as a result of the negative pressure. Moreover, because the panel 10 is fabricated from a flexible material, the panel 10 may deflect outwardly due to the force $F_{NP}$ with a catenary cross-section approximating the shape of a sagging bed sheet. The deflection of the panel 10 subjects the fasteners 20 and the support structure 14 to which the fasteners 20 are attached to torsion loads tending to rotate the fasteners 20 and support structure 14 in the direction indicated by the arrows in FIG. 3 and potentially resulting in greater pressures to the fasteners 20 and structure 14. However, as with the rigid panel 10, the design of the flexible panel 10 may account for the torsion loading by providing the requisite numbers and sizes of fasteners 20.

While the negative pressure condition is illustrated, those skilled in the art will understand that similar issues and types of loading are presented by positive pressure on the windward side of the structure during extreme weather conditions. Therefore, the panel 10 flexes or bows inwardly when positive pressure is applied, thereby creating torsion loads on the support structure in the opposite direction as in the illustrated negative pressure condition. Similarly, where a fabric covering is installed over an opening, the surface of the fabric covering is engaged by the edges of the walls surrounding and defining the opening when positive pressure is applied, thereby resulting in the application of torsion loads to the framing structure tending to rotate the structure inwardly.

The panels 10 illustrated in FIGS. 1-3 may be convenient where the openings 12 to be covered are readily accessible for installation of the panels 10, such as at street level. However, the panels 10 are difficult to install over openings 12 on higher floors. Moreover, the size and weight of the panels 10, and the number of fasteners 20 and the manner of their attachment may make the installation and removal of the panels 10 difficult and time consuming. Therefore, as an alternative to such panels, rolling protective shutters have been implemented for protection openings during hurricanes for many years. The rolling protective shutters may be permanently attached to the structure surrounding the openings, and include deployment mechanisms for quickly rolling and unrolling the shutter curtains. One type of known rolling shutter assembly 30 is shown in FIG. 4. The shutter assembly 30 has a shutter housing which includes a top wall 32, a pair of side walls or end caps 34, and a front wall 36. A shutter support member 40 is mounted for rotation within the shutter housing. The support member 40 includes a generally cylindrical central shaft 42 and a plurality of mounting members 44 fixed to the shaft 42. The upper end of a rolling shutter 50 is coupled to the mounting members 44. The shutter 50 is composed of a plurality of individual, elongate slats 52. The ends of the slats 52 are disposed within a pair of shutter tracks or side rails 60.

The illustrated shutter assembly 30 has a gearbox 62 which interconnects the rotatable shaft 42 with a hand crank 64 via a conventional gear assembly (not shown). When mounted to protect a window or other opening, the shutter tracks 60 of the shutter assembly 30 are positioned on either side of the opening and attached to the walls with fasteners, and the shutter housing is positioned over the top of the opening. Alternatively, in some applications, the side tracks 60 and shutter housing are positioned within the opening. When the shutter 50 is not in use, it is rolled up on the shutter support member 40 via the hand crank 64 so that it is at least partially enclosed by the shutter housing. The hand crank 64 may be disposed on a rear portion of the shutter assembly 10 so that the shutter 50, when attached over a window for example, can be unrolled from inside the window. Alternatively, when the gearbox 62 is not provided, the support member 40 may include a torsion spring. The shutter 50 may be rolled and unrolled with the assistance of the tension in the spring by exerting a force on a bottommost slat 66 by grasping a handle 68 that extends longitudinally along the slat 66 and outwardly from the shutter 50. Other drive mechanism, such as straps, tubular operators and motors are well known in the art and are used to open and close rolling shutters.

FIG. 5 schematically illustrates the shutter assembly 30 wherein the tracks 60 receive and guide the ends of the slats 52, and FIG. 6 schematically illustrates the reaction of the shutter 50 to the force F.sub.NP resulting from the negative pressure caused by the high winds during a hurricane. The side tracks 60 are secured to the corresponding support structures defining the left and right sides of the opening 14. In the normal position of FIG. 5, the shutter curtain 50 is not under tension so the ends of the slats 52 are fully extended into the side tracks 60. When the shutter curtain 50 is subjected to the force $F_{NP}$ as shown in FIG. 6, the shutter curtain 50 bows outwardly due to the force $F_{NP}$ thereby reducing the width of the shutter curtain 50 until one or both ends of the shutter curtain 50 pull free from the side tracks 60. While the shutter curtain 50 remains in the side tracks 60, the side tracks 60, fasteners 70 and corresponding support structures are subjected to the tensile and torsion loading as indicated by the arrows in FIG. 6. However, the loads created on the side tracks 60, support structures 14 and fasteners 70 typically do not cause catastrophic failures of those elements because the shutter curtain 50 will pull free from the side tracks 60 before the loading becomes too great.

Some panels as discussed above and other types of shutters exert their loads evenly on all sides simultaneously, thereby balancing the load on all sides. This may occur in panels and shutters having high levels of rigidity. The fasteners are subjected only to tension loading when the panel or shutter is subjected to negative pressure. Fasteners are designed with pull out ratings and are easily tested when subjected to this type of pressure. Rolling shutters as discussed above exert more pressure on the structure and fasteners due to their design. Until recently, rolling shutters were only able to span small openings for hurricane protection due to many factors. One factor is the issue of pull out of the shutter curtain as discussed above. Additionally, the housing at the top of the assembly 30 provides minimal structural support for the assembly 30, and the bottommost shutter slat 66 is typically not attached to the structure surrounding the opening 14 in a manner that provides structural support. Due to this, the side tracks 60 are the only components of the assembly 30 supporting the loading caused by pressure on the shutter curtain. The rolling shutter is not able to balance the pressures and loads on all four sides. Another problem arises from the planar profile and relatively small cross section of the rolling shutter curtain 50. The shutter curtain 50 is very flexible, and as it flexes, unless it is retained in the track in some manner, is easily pulled from the side tracks 60.

To prevent the shutter curtain 50 from pulling out of the side tracks 60 and to increase the capacity of the shutter curtain 50 to withstand positive and negative pressure loading during extreme conditions, end retention systems have been developed to hold the two ends of the slats 52 captive within the side tracks 60. FIGS. 7 and 8 illustrate an example of shutter slats 80 and a corresponding side track 100, respectively, configured to retain the ends of the slats 80 within the side track 100 when forces tend to cause the shutter curtain 50 to bow. Referring to FIG. 7, each slat 80 includes a double-wall slat portion 82, and is arc-shaped to facilitate rolling the shutter curtain onto the shutter support member 40. Each slat 80 further includes an elongated socket 84 integrally formed along the bottom edge 85 of the slat portion 82. A rod 86 is integrally formed along the top edge 87 of the slat portion 82. The rod 86 includes a groove or channel formed therein and running along the longitudinal length of the rod 86 to form an integral screw boss 88. The combined rod 86 and screw boss 88 approximate the shape of a second, smaller socket integrally formed on the edge 87 of the slat portion 82. The slats 80 are typically fabricated from extruded aluminum or polyvinyl chloride, but other materials and fabrication methods are known in the art.

The slats 80 are fabricated such that the inner diameter of the socket 84 is slightly larger than the outer diameter of the rod 86. The shutter curtain is assembled by sliding the rod 86 of one slat 80 into the socket 84 of the adjacent slat 80. The slats 80 are oriented with their concave surfaces on the same side of the shutter curtain so that the curtain rolls up properly onto the shutter support member 40. When the slats 80 are assembled, the rods 86 are pivotal within the sockets 84 to facilitate movement of the shutter curtain between the rolled and unrolled positions. Since the sockets 84 cover over half the diameter of the rods 86, the rods 86 are permanently retained within the sockets 84. The sockets 84 and rods 86 are configured to form a hinge that allows the connected slats 80 to rotate between a first position in which the sockets 84 and the rods 86 of the slats 80 are substantially linearly aligned, and a second position wherein the slat portions 82 combine to define an arc.

Once the shutter curtain is assembled, extension members 90 are attached to the screw bosses 88. The extension members 90 are adapted to keep the slats 80 vertically aligned and to captivate the shutter curtain within the side tracks 100 to prevent the shutter curtain from pulling out of the side tracks 100 during either an attempted break in or extreme wind conditions. Each of the extension members 90 has an inner flange 92 and an outer flange 94 separated by a neck 96 having a smaller diameter than the flanges 92, 94. Each extension member 90 further includes a threaded shank 98 that is dimensioned to correspond to the screw boss 88. The extension members 90 are attached to the shutter curtain by screwing the shanks 98 into the screw bosses 88 so that the extension members 90 are attached to both ends of a given screw boss 88.

The extension members 90 extend outwardly from the shutter curtain and the outer flanges 94 are captivated by the side tracks 100, as shown in FIG. 8, and prevent the shutter curtain from being pulled out of the shutter tracks 100. Each side track 100 has a pair of side walls 102, 104, and an end wall 106. The side track 100 further includes a pair of fins 112, 114 that extend inwardly from the side walls 102, 104, respectively, and define a gap 116 wide enough to receive the neck 96 of the extension member 90. The neck 96 of the extension member 90 extends through the gap 116 so that the outer flange 94 is disposed on the opposite side of the fins 112, 114 from the inner flange 92 and slat 80. The diameter of the outer flange 94 is larger than the gap 116 between the fins 112, 114 so that the outer flange 94 cannot be pulled through the gap 116. When the shutter curtain is subjected to a force perpendicular to its surface, such as the force $F_{NP}$ of the negative pressure generated during a hurricane as shown in FIG. 9, the slats 80 bow and the ends of the slats 80 move toward the opening in the side tracks 100. As the slats 80 bow, the outer flanges 94 of the extension members 90 are engaged by the fins 112, 114 of the side track 100 to retain the ends of the slats 80 within the side track 100. Similarly, the slats 80 bow inwardly when sufficient positive pressure is applied to the shutter curtain.

Other examples of slats for rolling shutter curtains configured to receive retention mechanisms for retaining the ends of the shutter curtains within the side rails can be found in U.S. Pat. No. 6,095,224, entitled "Shutter Tracks for Rolling Protective Shutters," U.S. Pat. No. 6,095,225, entitled "Shutter Slat with Integrated Screw Boss," and U.S.

Patent Publication No. 2005/0205221 A1, entitled "Dual Boss Shutter Slat with Retention Plate," the entire disclosures of which are incorporated herein by reference. In each case, retention members are connected to the ends of the slats of shutter curtains, and the side tracks are configured to engage the retention members and retain the ends of the slats within the side tracks.

Rolling shutters incorporating end retention are capable of withstanding higher pressures without the shutter curtain being pulled out of the side tracks than they had in the past. As a result, not only must the shutter curtain be designed and engineered to withstand the increased loading, but consideration must also be given to the relationship between the rolling shutter assembly and the building structure to which it is attached. Depending on the construction of the structure to which the rolling shutter is attached, the support structure may be the likely point of failure when the rolling shutter is subjected to extreme conditions. Sufficiently strong framing may not be available in buildings constructed without consideration to supporting the types and magnitudes of loading that the rolling shutters are designed to withstand. New construction may be able to take such loading into consideration, but existing construction may not.

For example, FIGS. 2, 3, 5, 6 and 9 schematically illustrate a wood framed house that is typical in many areas of the East Coast of the United States. The houses were designed before consideration of hurricane protection. Since glass is very rigid, and transfers weight evenly and in one direction, and has very little catenary reaction on the jambs, very few structural 2×4's were needed to provide the structural framing. Due to the amount of catenary force applied to the frame by today's rolling shutter systems, an opening of 5 feet could require four 2×4's to provide the minimum required wind protection. Unfortunately, most existing wood framed houses are not constructed with the required number of 2×4's. Due to this, many times the fasteners do not fail but the jamb fails.

Rolling shutter assemblies with end retention create problems that are unique as compared to many other types of shutter systems and protective panels, and that make these assemblies inappropriate for many applications. As discussed, the loads are concentrated on the sides tracks of the assembly. Moreover, the side tracks, fasteners and the structure of the building are subjected to torsion loading due to the simultaneous retention and bowing of the shutter curtain under pressure loading. The torsion loading is more severe than normal tension and sheer loading encountered by other shutters and panels. Since virtually all of the loading is supported by the two side tracks and the structure to which they are attached, it is extremely critical that the structure can withstand these highly concentrated loads. Consequently, a need exists for a rolling shutter that may be able to withstand pressure loading applied to the shutter curtain while transferring a reduced amount of the loading to the portions of the support structure to which the side tracks are attached. As noted above, though, flexible panels and fabric covers can also cause torsion loading on the support structure around the opening. Therefore, a need also exists for reducing the torsion loads transferred to the supporting structure by these types of coverings.

In certain situations, deflection of the shutter curtain needs to be minimized when subjected to positive pressure, negative pressure, or both. For example, sometimes the pressure loads applied by hurricane-force winds must to be redistributed from the framing to which the side tracks of the shutter assembly are attached to other portions of the support structure of the building. In these installations, a storm bar system may be used to redistribute the pressure loads. The ends of the storm bar are attach at either side of the rolling shutter so that the storm bar extends across and engages the shutter curtain to provide additional support for the pressure loads, and the storm bar may be fixed or removable. When the storm bar is oriented parallel to the side tracks and disposed on the coil side of the shutter curtain, a storm bar header is used to secure the top end of the storm bar.

Because the shutter curtain must be free to roll up and unroll, the storm bar header must be secured to the support structure at locations beyond the outer edges of the slats. Due to the required fasteners, many times the storm bar header may be longer than the shutter assembly. Moreover, the distance between the storm bar and the points of attachment of the storm bar header is also a problem in wood framed structures because the torsion loads at the ends of the storm bar header may be too great for the wood framing to support. Still further, the building may not have the required support structure beyond the width of the shutter assembly, or an adjacent shutter or other structure may restrict the ability to attach the storm bar header in the manner necessary to support withstand the required magnitude of pressure loading. Therefore, a need also exists for a mechanism for adequately securing a storm bar header for a rolling shutter in diverse configurations of support structures.

SUMMARY OF THE INVENTION

In one aspect, the invention is directed to a rolling shutter assembly for covering an opening of a structure defined by a top wall, a bottom wall and oppositely disposed side walls. The assembly includes a shutter housing, a shutter support member rotatably disposed within the shutter housing, a shutter having a plurality of individual slats and a plurality of hinges interconnecting the slats coupled to the shutter support member, the shutter comprising, and a pair of side tracks. The assembly further includes a support frame having a top rail, a bottom rail and a pair of oppositely disposed side rails. The support frame is mounted to the walls defining the opening with the top rail against the top wall, the bottom rail against the bottom wall and the side rails disposed proximate the corresponding side walls. The side tracks are each mounted to a corresponding one of the side rails of the support frame, and the shutter housing is mounted proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks.

In another aspect, the invention is directed to a method for mounting a rolling shutter assembly to support structure surrounding an opening of a building, wherein the opening is defined by a top wall, a bottom wall and oppositely disposed side walls. The assembly includes a shutter housing, a shutter support member rotatably disposed within the shutter housing, a shutter coupled to the shutter support member, the shutter comprising a plurality of individual slats and a plurality of hinges interconnecting the slats, a pair of side tracks, and a support frame having a top rail, a bottom rail and a pair of oppositely disposed side rails. The method includes mounting the support frame to the support structure with the top rail against the top wall, the bottom rail against the bottom wall and the side rails disposed proximate the corresponding side walls, mounting each of the side tracks to a corresponding one of the side rails of the support frame, and mounting the shutter housing proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks.

In a further aspect, the invention is directed to an improvement in a rolling shutter assembly for covering an opening of a structure defined by a top wall, a bottom wall and oppositely disposed side walls. The assembly includes a shutter housing, a shutter support member rotatably disposed within the shutter housing, a shutter coupled to the shutter support member, the shutter comprising a plurality of individual slats and a plurality of hinges interconnecting the slats, and a pair of side tracks. The shutter housing is mounted proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks. The improvement comprises a support frame having a top rail, a bottom rail and a pair of oppositely disposed side rails, wherein the support frame is mounted to the walls defining the opening with the top rail against the top wall, the bottom rail against the bottom wall and the side rails disposed proximate the corresponding side walls. The side tracks are each mounted to a corresponding one of the side rails of the support frame.

Additional aspects of the invention are defined by the claims of this patent.

DETAILED DESCRIPTION OF VARIOUS EMBODIMENTS

Figure 1:
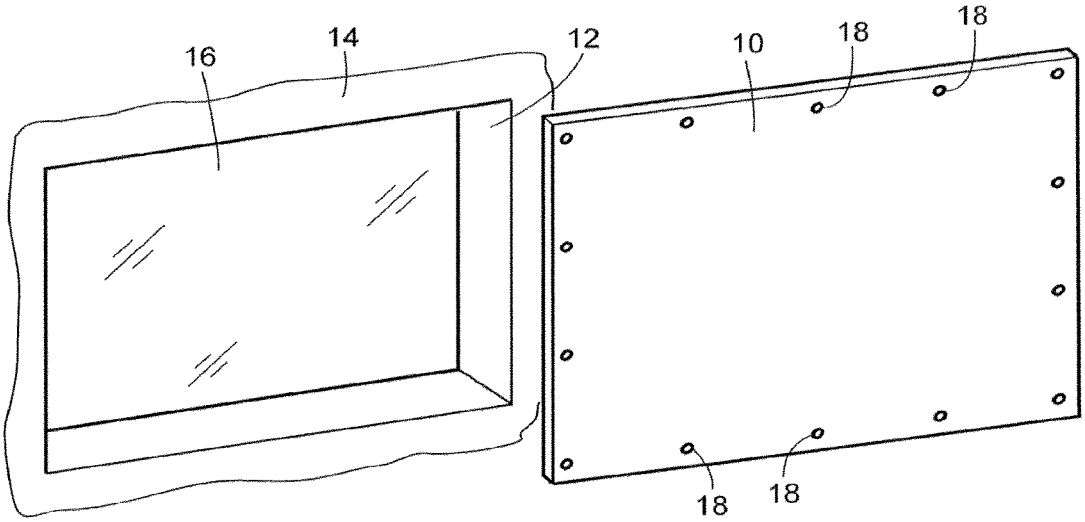
FIG. 1 PRIOR ART
FIG. 1 is a perspective view of an opening and a protective panel for covering the opening during a hurricane.
Figure 2:
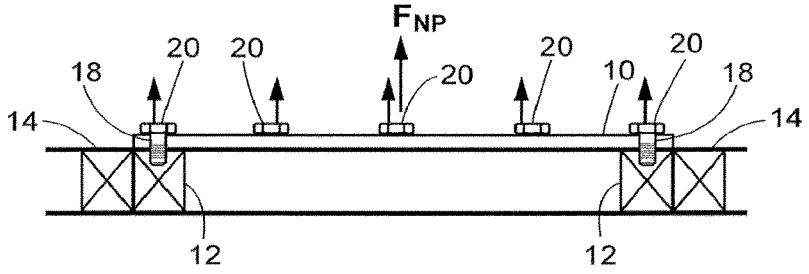
FIG. 2 PRIOR ART
FIG. 2 is a schematic illustration of the opening and the panel of FIG. 1 wherein the panel is fabricated from a rigid material and subjected to negative pressure.
Figure 3:
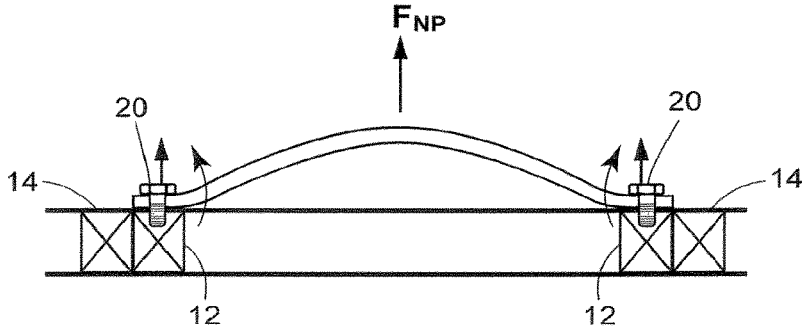
FIG. 3 PRIOR ART
FIG. 3 is a schematic illustration of the opening and the panel of FIG. 1 wherein the panel is fabricated from a flexible material and subjected to negative pressure.
Figure 4:
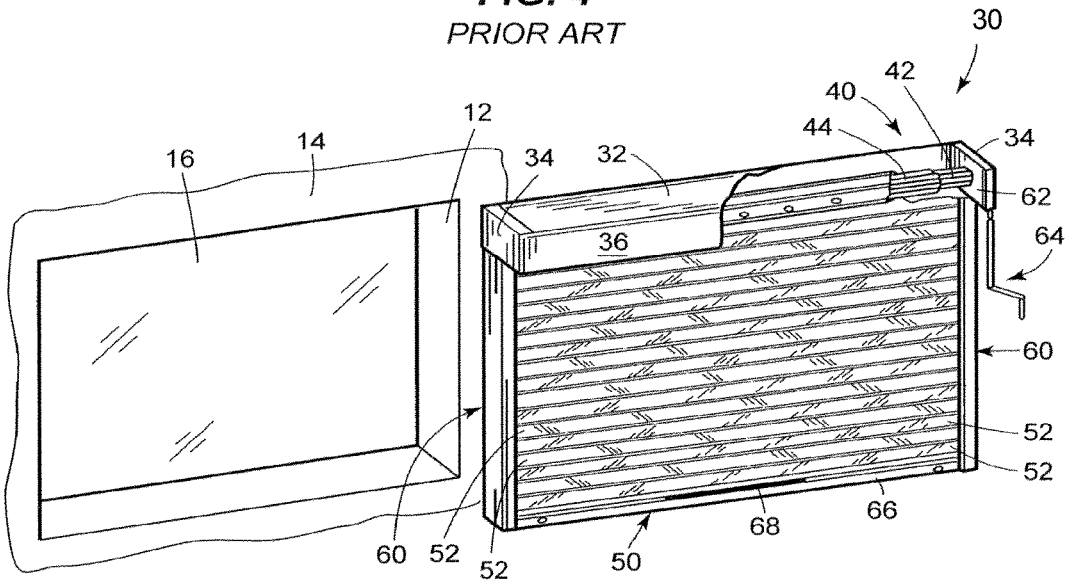
FIG. 4 PRIOR ART
FIG. 4 is a perspective view of an example of a rolling shutter assembly that may be disposed over an opening.
Figure 5:
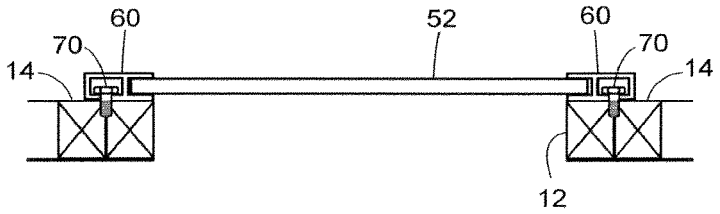
FIG. 5 PRIOR ART
FIG. 5 is a schematic illustration of the opening and rolling shutter assembly of FIG. 4 wherein the side tracks do not retain the ends of the shutter curtain.
Figure 6:
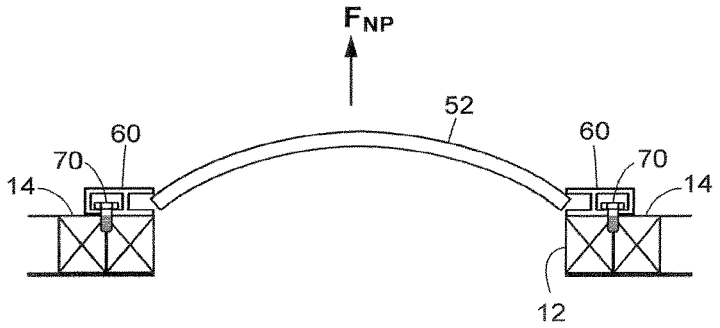
FIG. 6 PRIOR ART
FIG. 6 is a schematic illustration of the opening and rolling shutter assembly of FIGS. 4 and 5 subjected to negative pressure.
Figure 7:
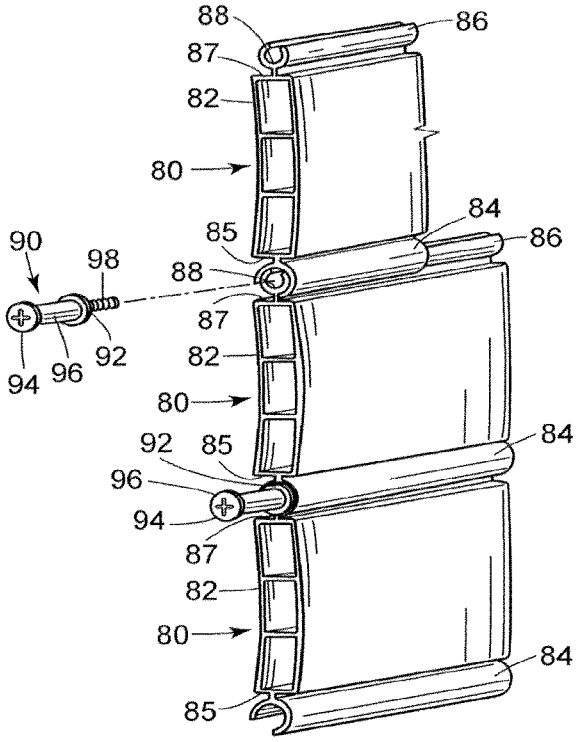
FIG. 7 PRIOR ART
FIG. 7 is a fragmentary perspective view of a shutter curtain formed by double-wall slats and including retention members for securing the ends of the slats within the side rails of the rolling shutter assembly of FIG. 4.
Figure 8:
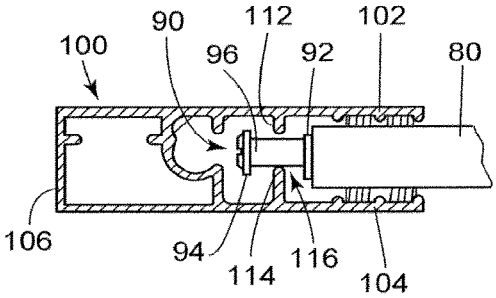
FIG. 8 PRIOR ART
FIG. 8 is a cross-sectional top view of the shutter curtain of FIG. 7 disposed within a side track of the rolling shutter assembly of FIG. 4.
Figure 9:
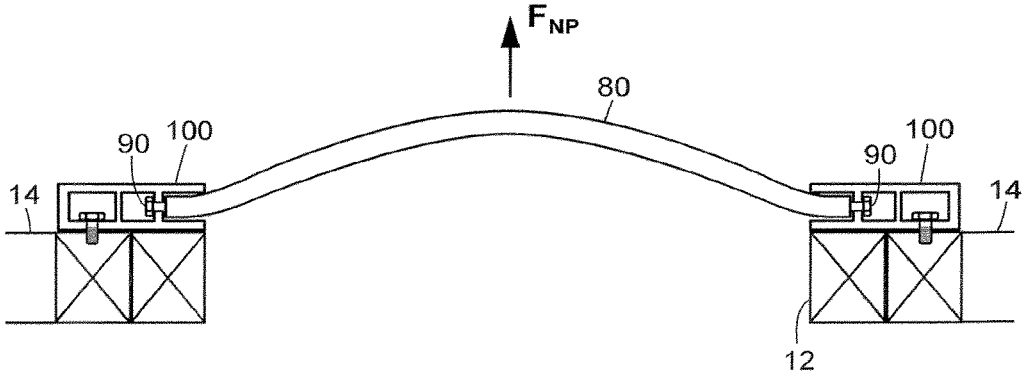
FIG. 9 PRIOR ART
FIG. 9 is a schematic illustration of the opening and rolling shutter assembly of FIGS. 4, 7 and 8 subjected to negative pressure.

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

In order to increase the strength of an end retention rolling shutter and to protect the supporting structure around the opening and to which the rolling shutter is mounted, a support frame is provided that is attached to the supporting structure so that the support frame engages the top and bottom walls defining the opening as well as the side walls. Once the support frame is attached to the support structure, the side tracks of the rolling shutter are secured to the side rails of the support frame, and the shutter housing is mounted on the side tracks to complete the installation. When the rolling shutter is subjected to negative pressure during a hurricane as discussed above, the support frame prevents a significant amount of torsion loading from being transmitted from the side tracks to the side walls on either side of the opening. The force resulting from the negative pressure is distributed around the support frame and borne by the fasteners connecting the support frame on all sides of the opening. Consequently, torsion loading concentrated on the side walls of the support structure may be greatly reduced or eliminated, thereby allowing the rolling shutter and support frame to withstand more severe hurricane conditions than is possible with the rolling shutter alone.

Figure 10:
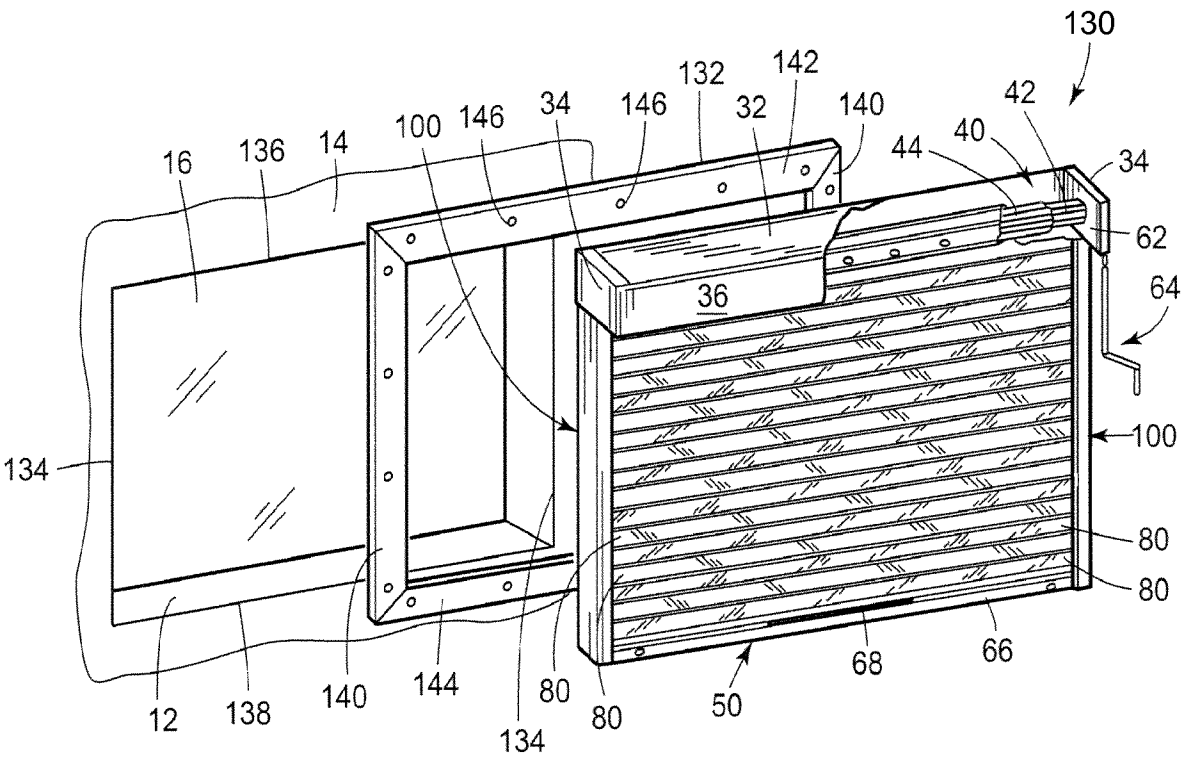
FIG. 10 is a perspective view of an embodiment of a rolling shutter assembly with end retention and including a support frame.

FIG. 10 illustrates one embodiment of a rolling shutter assemble 130 including a support frame 132 for mounting the rolling shutter about the opening 12 defined by side walls 134, top wall 136 and bottom wall 138. The rolling shutter is similar to the shutter assembly discussed above and may include end retention of the shutter curtain, such as that provided by a shutter curtain formed by slats 80 having extension members 90 and side tracks 100. The support frame 132 includes oppositely disposed side rails 140 connected to top and bottom rails 142, 144, respectively, extending therebetween at opposite ends of the side rails 140. The rails 140-144 are connected in any appropriate manner, such as those described further below, to provide the desired rigidity and structural support, or the support frame 132 may be fabricated from a unitary piece of material. In one embodiment, the rails 140-144 are fabricated as hollow rectangular tubes of extruded aluminum and connected by welding or by insertion of unitizing inserts at the corners to secure the adjoining rails 140-144. To facilitate attachment with the appropriate fasteners, the rails 140-144 include a plurality of openings 146 through their front walls dimensioned to allow the heads of the fasteners to be inserted into the rails 140-144 and through corresponding smaller openings (not shown) to anchor the support frame 132 to the corresponding walls 134-138.

The rolling shutter assembly 130 is installed around the opening 12 by first mounting the support frame 132 to the support structure. Each of the rails 140-144 is fastened to the corresponding wall 134-138 defining the opening 12. However, the installation where the anticipated conditions and the strength of the support frame 132 may permit, the top rail 142 and bottom rail 144 may be disposed against the top wall 136 and bottom wall 138, respectively, without actually being attached to the walls 136, 138 with fasteners. After the support frame 132 is mounted to the opening 12, the side tracks 100 are attached to the corresponding side rails 140 of the frame 132. The side tracks 100 may be attached to the side rails 140 using any appropriate fasteners, such as bolts, rivets and the like. Alternatively, the side tracks 100 may be welded to the side rails 140. As a further alternative, each side rail 140 and corresponding side track 100 may be fabricated as a single unitary component such that the side tracks 100 are mounted to the opening along with the side rails 140 of the frame. Once the side tracks 100 are mounted to the support frame 132, the shutter housing is attached to the top ends of the side tracks 100 so that the shutter curtain contained therein may be unrolled into the space between the side tracks 100. If necessary and/or desired for further support, the shutter housing may also be attached to the top wall 136, the top rail 136, or both.

Figure 11:
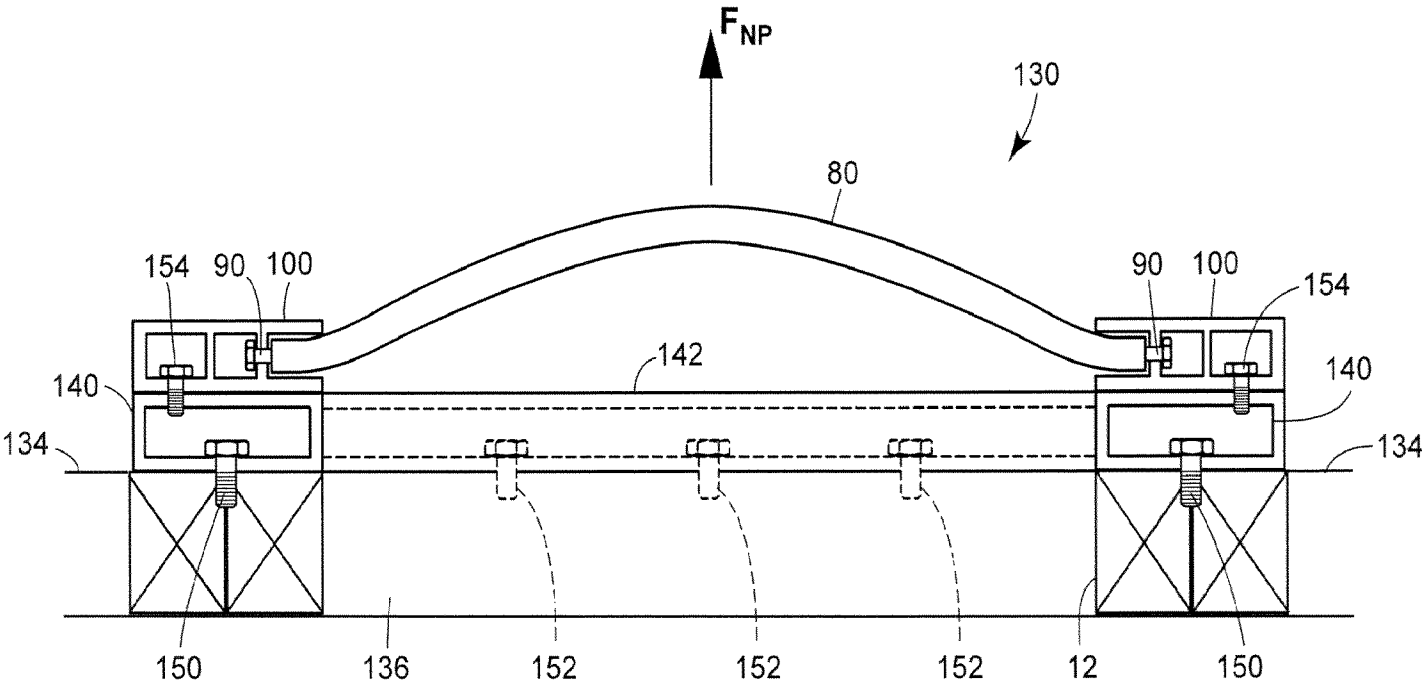
FIG. 11 is a schematic illustration of the opening and rolling shutter assembly of FIG. 10 subjected to negative pressure.

FIG. 11 is a schematic illustration of the rolling shutter assembly 130 viewed from the bottom wall 138 and showing the reaction of the rolling shutter assembly 130 to the force $F_{NP}$ created by negative pressure during a hurricane. The side rails 140 are connected to the side walls 134 by fasteners 150, the top rail 142 is connected to the top wall 136 by fasteners 152, and the side tracks 100 are connected to the side rails 140 by fasteners 154. As previously discussed, the slats 80 bow and the ends of the slats 80 move toward the openings of the side tracks 100 as the force $F_{NP}$ increases. As the slats 80 bow, the extension members 90 are engaged by the fins of the side track 100 to retain the ends of the slats 80 within the side tracks 100. The engagement of the slats 80 by the fins and the front walls of the side tracks 100 generate shear, tension and torsion loading on the fasteners 154 that are transmitted to the side rails 140 by the fasteners 154. The shear loads transmitted to the side rails 140 tend to pull the side rails 140 inwardly and are supported, at least initially, by the side rails 140, the top rail 142 and the bottom rail 144 of the support frame 132. The transmitted tension loads tending to pull the rolling shutter assembly 130 are distributed about the support frame 132 among the fasteners 150, 152 and the fasteners connecting the bottom rail 144 to the bottom wall 138 in a similar manner as the fasteners of the rigid panel 10 discussed above.

The transmitted torsion loads tending to rotate the side rails 140 and the side walls 134 to which they are attached are initially supported by the structure of the support frame 132 without transmission of the torsion loads to the walls or the fasteners. It should be noted that the direction and magnitude of the torsion loads will be determined based on the magnitudes and lines of action of the shear and tension loads, and the relative positions of the fasteners 150 and 154. Therefore, depending on the particular implementation of the rolling shutter assembly 130 and connection of its components, the torsion loads may tend to rotate the side rails 140 in the direction that pulls the top rail 142 and the bottom rail 144 away from the support structure, or in the direction that presses the top rail 142 and the bottom rail 144 against the support structure. In either case, the torsion loads are initially supported by the side rails 140 due to the rigidity of the support frame 132.

As the force $F_{NP}$ increases, the shear, tension and torsion loads correspondingly increase. Depending on the rigidity of the support frame 132, the torsion loading on the side rails 140 may eventually be sufficient to cause the side rails 140 to deflect and to begin applying the torsion loads to the framing elements of the side walls 134. At this point, the top rail 142 and the bottom rail 144 function as lever arms counteracting the twisting of the side rails 140 and reducing or eliminating the magnitude of the torsion load transmitted to the side walls 134. If the torsion load from the side tracks 100 rotates the side rails 140 in the direction to pull the top rail 142 and bottom rail 144 away from the walls 136, 138, respectively, the tension in the fasteners 152 and the fasteners connecting the bottom rail 144 provide a force tending to rotate the side rails 140 in the opposite direction against the torsion load. Conversely, if the torsion load from the side tracks 100 rotates the side rails 140 in the direction to press the top rail 142 and bottom rail 144 against the walls 136, 138, respectively, the reactive forces from the framing of the top and bottom walls 136, 138 against the top and bottom rails 142, 144, respectively, also tend to rotate the side rails 140 in the opposite direction against the torsion load.

Consequently, in either configuration, the top rail 142 and bottom rail 144 provide the forces necessary to reduce or eliminate the torsion loading on the framing structure of the side walls 134.

The loads created during positive pressure conditions are generally supported in a similar manner. Shear and torsion loads are supported by the support frame 132 as discussed above and depending on the direction of application of the torsion loads. Therefore, torsion loading of the framing elements surrounding the opening is reduced or eliminated in positive pressure conditions as well. Instead of tension loading on the fasteners 150 due to the negative pressure force $F_{NP}$ as discussed above, positive pressures cause compression loading against the support frame 132 and, consequently, against the framing elements of the walls 134-138.

In addition to the load-bearing advantages of the support frame 132 as discussed above, the support frame 132 may also serve to align the rolling shutter assembly 130 or other covering when the surfaces surrounding the opening are uneven. The walls surrounding the opening may not necessarily be flat by design, or due to imperfections and flaws present when the structure was constructed or occurring afterwards. For example, stucco walls by their nature likely will not present a perfectly flat plane around the opening. Moreover, inartful plastering may create mounds and valleys in the outer surface of a wall that may prevent the side tracks 100 of the rolling shutter assembly 130 from being mounted evenly on the wall, and may prevent the side tracks 100 from being aligned on the walls without altering the walls or providing alignment mechanisms such as shims to ensure the side tracks 100 are square to each other and to the shutter curtain. These issues may be eliminated by the support frame 132 which, due to its rigidity, remains square to itself even when mounted on uneven surfaces such that the side rails 140 provide planar surfaces to which the side tracks 100 are attached despite the unevenness of the underlying walls surrounding the opening.

Figure 12:
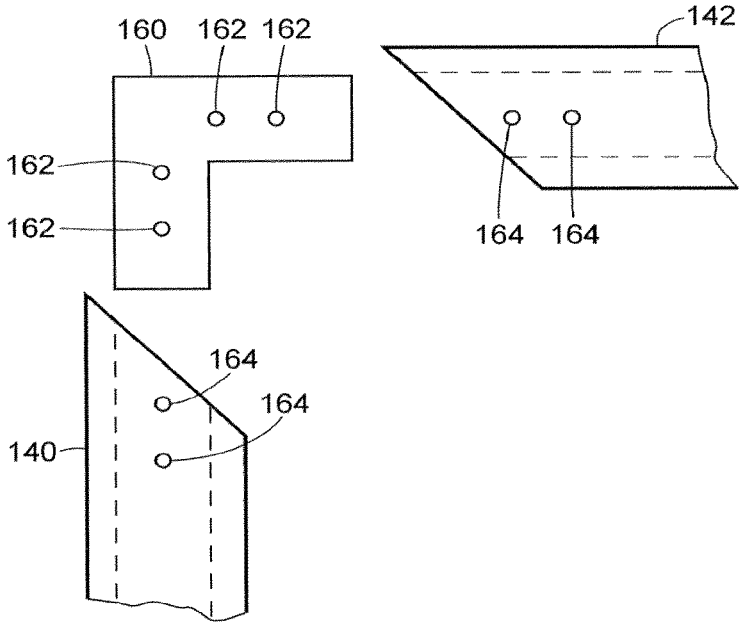
FIG. 12 is an exploded view of a corner assembly of the support frame of FIG. 10.
Figure 13:
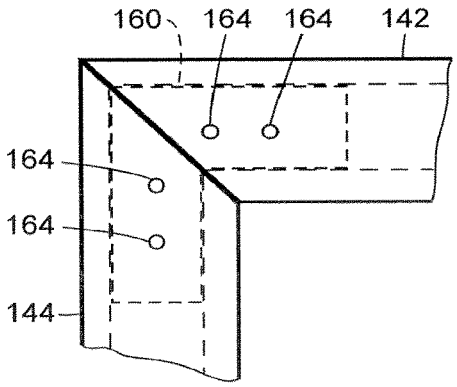
FIG. 13 is a front view of the assembled corner assembly of the support frame of FIG. 12.
Figure 14:
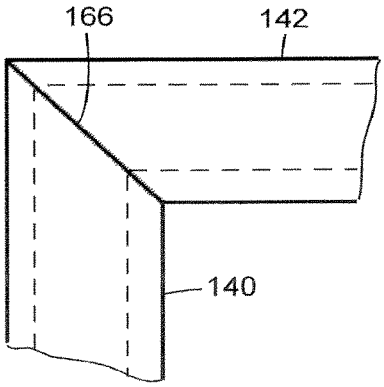
FIG. 14 is a front view of an alternative embodiment of a corner assembly of the support frame of FIG. 10.

As discussed above, the support frame 132 may be fabricated as a single unitary component, or the rails 140-144 may be fabricated separately, cut to the appropriate lengths if necessary, and assembled to form the support frame 132. FIGS. 12 and 13 illustrate one method for fabricating a unitized support frame 132. Referring to FIG. 12 which shows the corner of the support frame 132 formed by the top rail 142 and one of the side rails 140, the rails 140, 142 are fabricated from extruded aluminum to form hollow rectangular rails. The ends of the rails 140, 142 are beveled to form a mitered corner of the support frame 132. An L-shaped unitizing insert 160 is configured to be received in the beveled ends of the adjoining rails 140, 142 to provide additional support at the point of connection. The unitizing insert 160 may include openings 162 therethrough on each leg that will align (See FIG. 13) with corresponding openings 164 through the walls of the rails 140, 142 to receive fasteners (not shown) for securing the rails 140, 142 together in a manner that provides structural integrity to the corner of the support frame 132. FIG. 14 illustrates a further alternative embodiment wherein the ends of the rails 140, 142 are connected by a weld 166. If desired, the weld 166 may be used as an alternative fastening mechanism with the unitizing insert 160. Other mechanisms for connecting the rails 140-144 to form the support frame 132 will be apparent to those skilled in the art and are contemplated by the inventor as having use in a rolling shutter assembly in accordance with the present disclosure.

While the rolling shutter assembly 130 is illustrated as covering an opening surrounded by a flat wall and having a recessed window, the rolling shutter assembly 130 may be configured to be mounted about or within other types of openings wherein the rolling shutter assembly 130 cannot simply be mounted against a flat exterior wall. For example, in many installations, obstructions in the way of the curtain path prevent the rolling shutter from being mounted flush against the exterior wall, and the rolling shutter must be disposed beyond the obstruction in order to close. Currently, build-out tubes having sufficient depth to allow the shutter curtain to avoid the obstruction are attached between the side walls and the side tracks of the rolling shutter assembly. However, the build-out tubes are not configured to extend across and be fastened to the top and/or bottom walls defining the opening. In such installations, the support frame 132 may be substituted for the build-out tubes to provide attachment to and support by the top and bottom walls of the opening as described above. The support frame 132 may be configured with sufficient depth to that the shutter curtain is disposed beyond the obstruction and is capable of being closed when necessary.

Figure 10A:
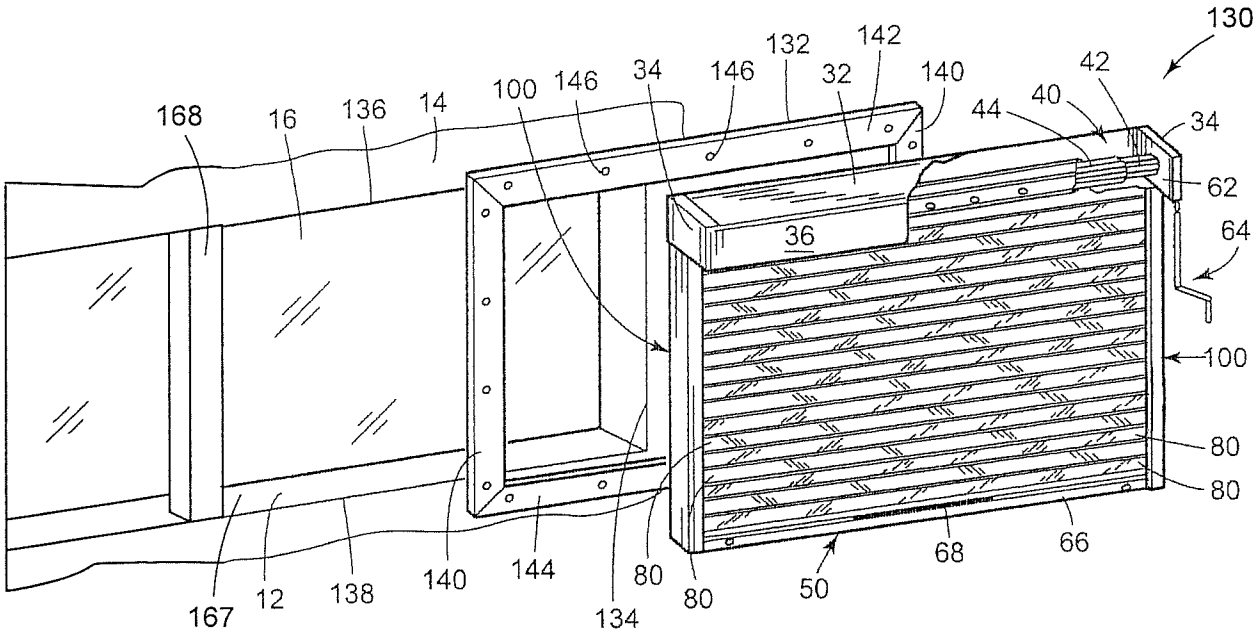
FIG. 10*a* is a perspective view of the rolling shutter assembly of FIG. 10 and a wide opening divided by a mullion.

In other installations, the openings may not have sufficient vertical support structures for mounting the rolling shutter across a particular opening. For example, extremely wide openings 167, such as those shown in FIG. 10*a*, cannot be covered by a single rolling shutter 30 due to the planar profile and relatively small cross section of the rolling shutter curtain 50 that make the shutter curtain 50 very flexible and difficult to retain within the side tracks 100. Such wide openings 167 may necessitate the installation of two or more rolling shutters 130 disposed side-by-side and abutting to cover the entire width of the opening 167. In order to support the side tracks 100 disposed within the opening 167, mullions 168 are installed at the necessary positions within the opening 167, and the internal side tracks 100 are attached to the corresponding mullions 168. In one embodiment, a separate support frame 132 may be provide with each individual rolling shutter assembly 130, and may have one of the side rails 140 connected between the corresponding side track 100 and mullion 168. Alternatively, a single support frame 132 may be provided that is dimensioned to surround the entire opening 167 with the rails 140-144 fastened to the walls 134-138 as described above. In this embodiment, the support frame 132 may further include intermediate vertical rails securely connected between the top rail 142 and bottom rail 144 and disposed at positions corresponding to internal side rails 140 and mullions 168.

Figure 15:
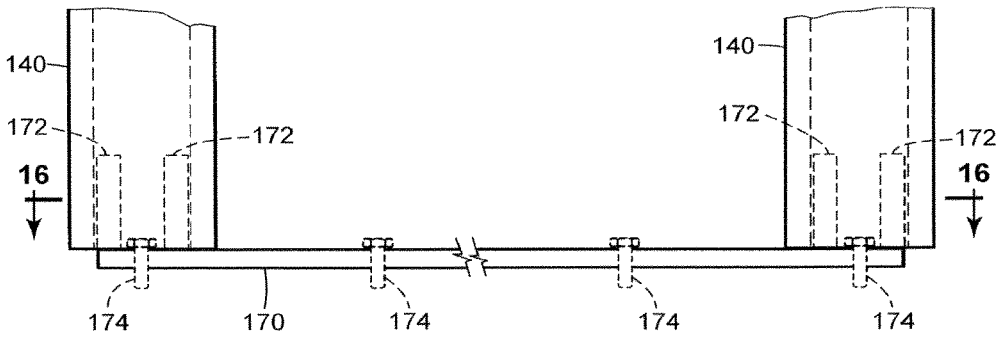
FIG. 15 is a front view of the lower portion of an alternative embodiment of a support frame having a bottom rail in the form of a plate for attachment to a threshold.
Figure 16:
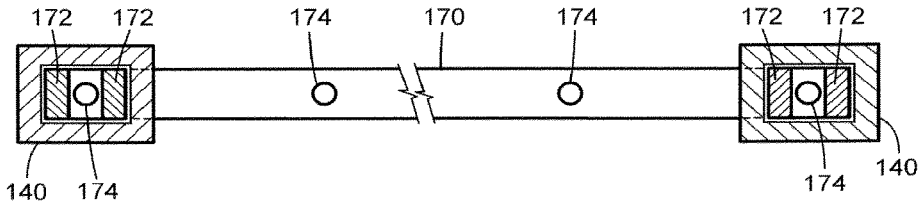
FIG. 16 is a cross-sectional view through line 16-16 of FIG. 15 of the lower portion of the support frame of FIG. 15.

Modifications to the support frame 132 may be required when one of the walls extends outwardly at the opening while the remaining surrounding walls are flush with each other. Such a situation may exist when a rolling shutter is installed to cover a doorway or storefront such that a threshold extends outwardly at the bottom of the opening. In this type of installation, use a support frame 132 with the bottom rail 144 as described above may obstruct the doorway or storefront and create a tripping hazard when the shutter curtain is in its normal open position. FIGS. 15 and 16 illustrate an alternative embodiment of the support frame 132 wherein the bottom rail 144 is replaced by a plate 170 having low profile that presents substantially less obstruction in the entranceway. The bottom ends of the side rails 140 may be straight and parallel to the ground instead of beveled as discussed above, and the plate 170 may have upwardly extending flanges 172 that are inserted into the ends of the side rails 140 and engage the inner surfaces of the side rails 140 to form a unitized structure. During installation, the plate 170 is secured to the threshold by fasteners 174. When the side rails 140 are subjected to sufficient torsion loading to cause deflection of the side rails 140, the deflection transmitted through the flanges 172 tends to rotate the plate 170 in a direction parallel to the threshold. A combination of the rigidity of the plate 170 and the resistance of the fasteners 174 to the resulting shear loads produce the forces necessary to reduce or eliminate the torsion loading on the framing structure of the side walls 134 in a similar manner as described above for the bottom rail 144.

Figure 17:
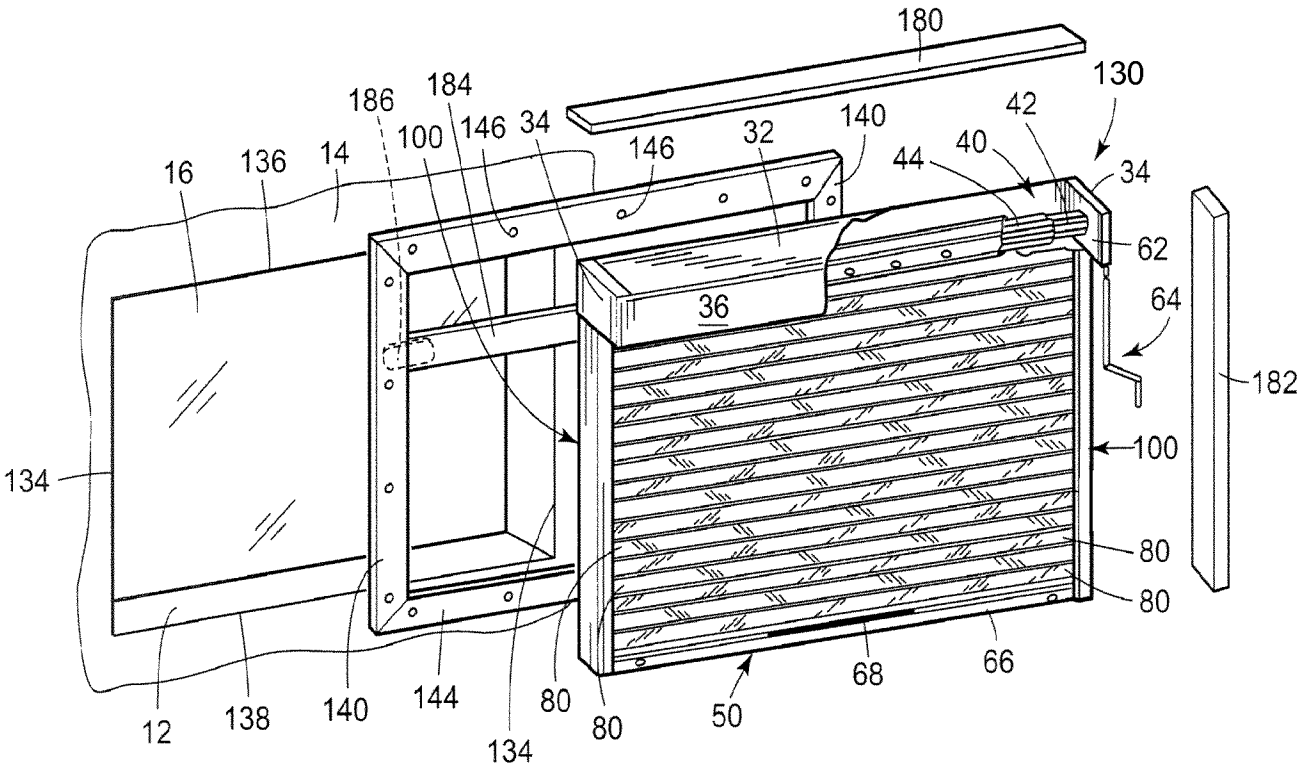
FIG. 17 is a perspective view of an embodiment of a rolling shutter assembly with end retention and including a support frame configured for attachment of a storm bar header.

As discussed above, in certain installations deflection of the shutter curtain is minimized by providing a storm bar to redistribute the pressure loads on the rolling shutter and surrounding framing structure. Where the storm bar is located in front of the shutter curtain, a storm bar header is used to attach the top end of the storm bar proximate the shutter housing. FIG. 17 illustrates the rolling shutter assembly 130 with the support frame 132 configured for attachment of a storm bar header 180 thereto in a manner that allows the support frame 132 to distribute the load applied to a storm bar 182 by the shutter curtain. The support frame 132 includes a horizontal lever arm 184 extending between the side rails 140 and providing additional structural support for the loads generated by the shutter curtain engaging the storm bar 182. The lever arm 184 is located at a level corresponding to the location at which the storm bar header 180 is to be disposed. The lever arm 184 may be connected to side rails 140 by unitizing inserts 186 that are inserted into the ends of the lever arm 184 and through corresponding openings (not shown) through the inner walls of the side rails 140. The lever arm 184 and unitizing inserts 186 may be connected to each other and to the side rails 140 by fasteners, welds or any other appropriate connection mechanism.

Figure 18:
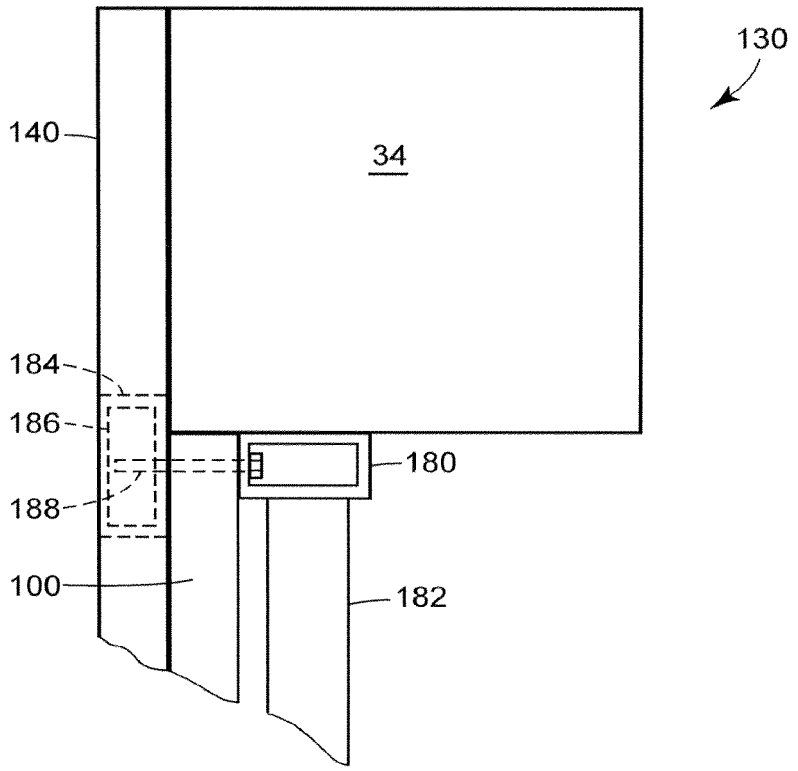
FIG. 18 is a side view of the rolling shutter assembly of FIG. 17 with the storm bar header attached to the support frame.

FIG. 18 illustrates the rolling shutter assembly 130 with the storm bar header 180 connected to the support frame 132 through the side rail 140 and unitizing insert 186, and with the storm bar 182 attached to the storm bar header 180. Mechanisms for temporarily or permanently connecting the storm bar 182 to the storm bar header 180, as well as connecting the bottom end of the storm bar 182 proximate the bottom of the shutter assembly 130, are well known to those skilled in the art and are contemplated by the inventor as having use in rolling shutter assemblies in accordance with the present disclosure. The ends of the storm bar header 180 are connected to the side rails 140 and corresponding unitizing inserts 186 via fasteners 188 that may pass through the side tracks 100. It should be noted that in the present embodiment the storm bar header 180 need not be directly fastened to the framing structure surrounding the opening as was necessary with previously know rolling shutter assemblies. Further, because the storm bar header 180 is fastened directly to the support frame 132, the storm bar header 180 does not have to extend beyond the edges of the rolling shutter assembly 130. When a load is applied to the storm bar 182 by the shutter curtain and transmitted to the support frame 132 by the storm bar header 180, the additional support provided by the lever arm 184 and unitizing inserts 186 further resists the deflection of the side rails 140 in response to the torsion loads generated by the force $F_{NP}$ of the negative pressure.

While the support frame 132 has been illustrated and discussed herein in combination with a rolling shutter covering an opening, those skilled in the art will understand that the support frame 132 may also be implemented in combination with flexible panels and fabric covers to reduce or elimination torsion loading on the framing elements. In contrast to the rolling shutter having the side rails 100 mounted to the side rails 140, a flexible panel or fabric cover may be attached to the top rail 142 and bottom rail 144 as well. With the added rigidity of the support frame 132, the torsion loads created by the flexible panels and fabric covers under positive pressure conditions as described above are supported by the frame 132 such that the torsion loads are not transmitted to the framing elements of the walls 134-138 surrounding the opening.

Figure 19:
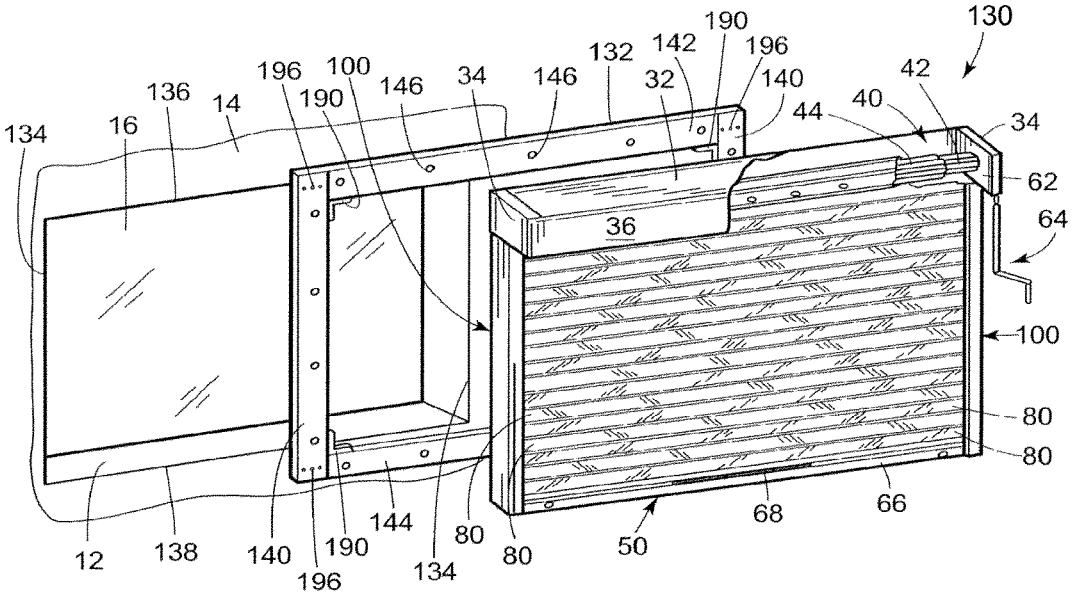
FIG. 19 is a perspective view of an embodiment of a rolling shutter assembly with end retention and including an alternative embodiment of a support frame.

FIGS. 19-22 illustrate a further alternative embodiment for the support frame 132 having an alternative mechanism for securing the top and bottom rails 142, 144, respectively, to the side rails 140. Referring to FIG. 19, the mitered corner assemblies discussed above are replaced by a configuration in which the walls of the side rails 140 are partially removed so that the ends of the top and bottom rails 142, 144 may be partially nested and received at the ends of the corresponding side rails 140. The adjoining rails are secured to each other by fasteners, adhesive, welding or other appropriate connection mechanism. The corner assemblies may further include angle brackets 190 attached to the adjoining rails at the inside corners thereof for additional structural support.

Figure 20:
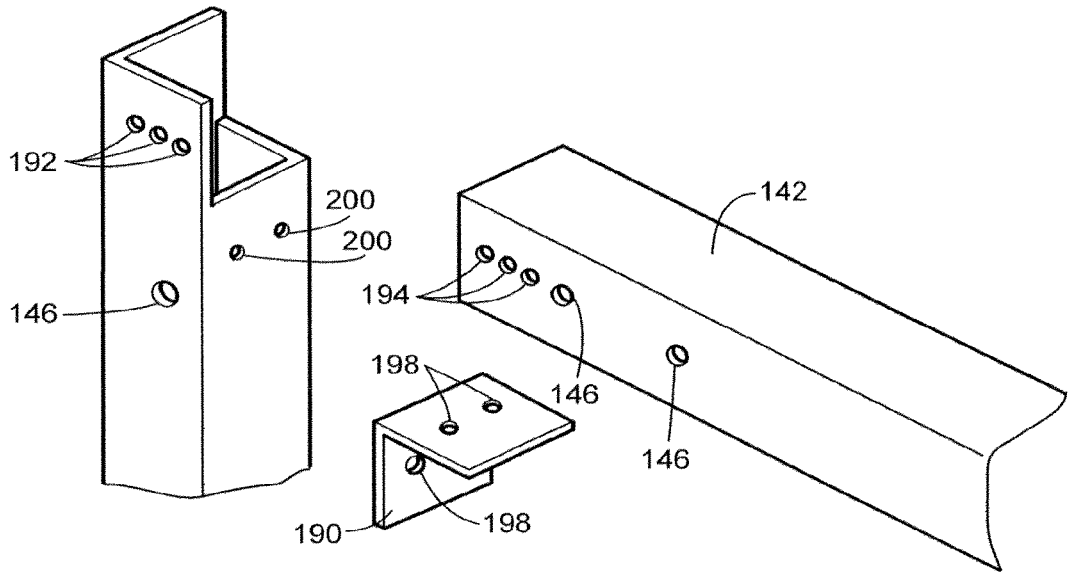
FIG. 20 is a partially exploded isometric view of a corner assembly of the support frame of FIG. 19.
Figure 21:
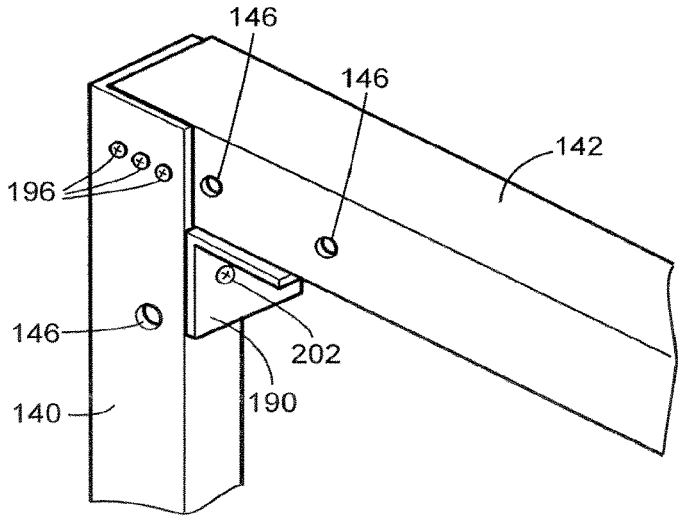
FIG. 21 is an isometric view of the corner assembly of the support frame of FIG. 19.

Referring now to FIGS. 20 and 21, the details of the corner assemblies are illustrated. The inside and rear walls at the ends of the side rails 140 are removed so that the walls do not extend to the ends of the side rails 140 to allow the ends of the top and bottom rails 142, 144 to abut the inside surfaces of the outside walls of the side rails 140. The removed portions of the inside and rear walls may have lengths approximately equal to the width of the top and bottom rails 142, 144 so that the top and bottom rails 142, 144 are approximately flush with the ends of the side rails 140 when the top and bottom rails 142, 144 are nested therein. Holes 192 of the front wall of the side rail 140 may align with corresponding holes 194 of the top rail 142 when the end of the top rail 142 is nested so that fasteners 196 may secure the rails 140, 142. The angle bracket 190 may then be positioned at the inside corner of the corner assembly with holes 198 aligned with corresponding holes 200 of the rails 140, 142 for attachment with fasteners 202, for example. Similar connections of the adjoining rails are made at the other corners of the support frame 132.

Figure 22:
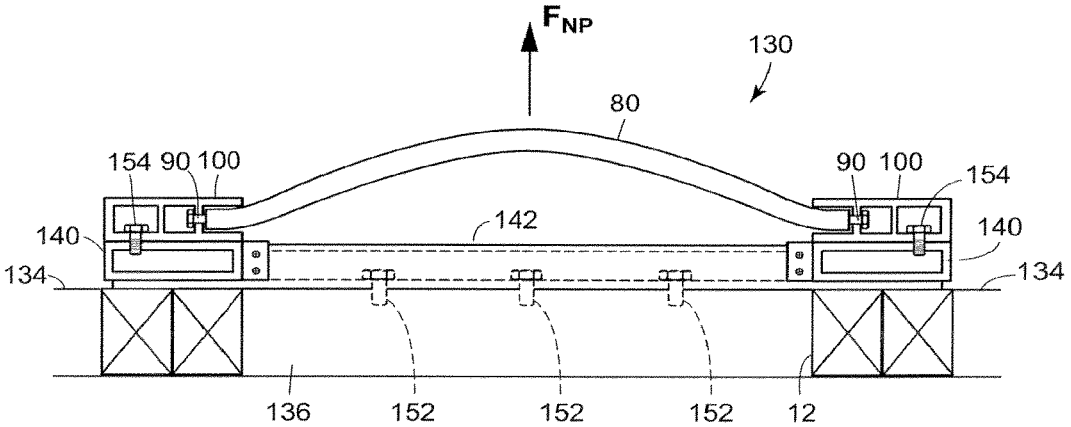
FIG. 22 is a schematic illustration of the opening and rolling shutter assembly of FIG. 19 subjected to negative pressure.

As best seen in FIG. 21, in the illustrated embodiment the depth of the side rail 140 and the top rail 142 are the same such that the rear surface of the top rail 142 extends beyond the rear surface of the side rail 140. Consequently, the side rail 140 may be disposed proximate the side wall 134 of the opening 12 similar to the embodiments discussed above, but not against the side wall 134 as shown in FIG. 22. In this configuration, the support frame 132 may be mounted about the opening with the top and bottom rails 142, 144 against and secured to the top and bottom walls 136, 138, respectively, of the opening 12. At the same time, the side rails 140 are proximate to but spaced from the side walls 134 of the opening 12, and are not necessarily secured to the side walls 134. When the negative pressure $F_{NP}$ is applied to the cover, the force is taken up by the top and bottom rails 142, 144 and transferred to the top and bottom walls 136, 138, and the shear, torsion and tension loads on the framing elements of the side walls 134 are significantly reduced or eliminated. Depending on the magnitude of the negative pressure $F_{NP}$ and the properties of the support frame 132, the side rails may temporarily deflect and twist under the loading on the side tracks 100 without causing twisting and torsion loads on the framing elements of the side walls 134. Of course, depending on the installation, the side rails 140 may still be secured to the side walls 134 in a similar manner as described above. Additionally, the top and bottom rails 142, 144 may have smaller depths so that the rear surfaces of the top and bottom rails 142, 144 are flush with the rear surfaces of the side rails 140, with the rear surfaces of the side rails 140 against the corresponding side walls 134 of the opening 12. In this configuration, the side rails 140 may or may not be fastened to the side walls 134.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A rolling shutter assembly for covering an opening of a structure defined by a support structure having a top wall, a bottom wall and oppositely disposed side walls, the rolling shutter assembly providing hurricane protection for the opening during a hurricane, the assembly comprising:

a shutter housing;

a shutter support member rotatably disposed within the shutter housing;

a shutter coupled to the shutter support member, the shutter comprising a plurality of individual slats and a plurality of hinges interconnecting the slats;

a pair of side tracks, wherein the shutter housing is mounted proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks with the side tracks engaging the ends of the slats to retain the ends of the slats within the side tracks such that the side tracks deflect inward toward each other and twist relative to the side walls when the shutter is in the unrolled position and the loading caused by the hurricane is applied to the shutter and the side tracks; and a support frame having a top rail, a bottom rail, a pair of oppositely disposed side rails connected to the top rail and the bottom rail to form the support frame with a corner defined at each connection between an end of one of the side rails and a corresponding end of one of the top rail and the bottom rail, and a plurality of structural support members each disposed at one of the corners of the support frame and attached to the side rail and to the top rail or the bottom rail to which the side rail is connected at the corresponding corner to transfer torsional loads created by the side tracks on the side rails to the top rail and the bottom rail, wherein the side tracks are each mounted to a corresponding one of the side rails of the support frame, wherein the support frame is mounted to the walls of the support structure defining the opening with the top rail anchored to the top wall with a first plurality of fasteners extending through the top rail and into the top wall, the bottom rail anchored to the bottom wall with a second plurality of fasteners extending through the bottom rail and into the bottom wall, and the side rails disposed proximate the corresponding side walls and not secured to the side walls with fasteners extending through the side rails and into the side walls so that the side rails deflect inward toward each other and twist relative to the side walls and do not apply twisting and torsion loads to the side walls when loads are applied to the side rails by the side tracks when the shutter is in the unrolled position and the loading on the shutter caused by the hurricane causes the side tracks to deflect inward toward each other and twist relative to the side walls, and wherein the loading caused by the hurricane is transferred by the structural support members from the side rails to the top and bottom rails and the top and bottom walls.

2. A rolling shutter assembly as defined in claim 1, wherein the side rails of the support frame are against the corresponding side walls of the support structure defining the opening.

3. A rolling shutter assembly as defined in claim 1, wherein one of the side walls defining the opening is a mullion, and wherein one of the side rails of the support frame is disposed against the mullion.

4. A rolling shutter assembly as defined in claim 1, wherein the opening has a mullion extending between and connected to the top wall and the bottom wall defining the opening, wherein the support frame comprises an intermediate vertical rail extending between and connected to the top rail and the bottom rail and positioned to align with the mullion when the support frame is attached to the walls, and wherein the intermediate vertical rail is anchored to the mullion and one of the side tracks of the rolling shutter assembly is anchored to the intermediate vertical rail.

5. A rolling shutter assembly as defined in claim 1, wherein the top and the side rails are hollow tubes, wherein the ends of the top and the side rails are beveled such that the adjoining rails form a mitered corner, and wherein the support frame comprises a plurality of L-shaped unitizing inserts each disposed at one of the corners of the support frame with one leg extending into the end of each of the adjoining rails, and wherein each leg of the L-shaped unitizing insert is connected to the corresponding end of one of the rails to secure the ends of the adjoining rails forming the corner.

6. A rolling shutter assembly as defined in claim 1, wherein the top, the bottom and the side rails are hollow tubes having front, rear, inside and outside walls, wherein inside and rear walls of the side rails do not extend to the ends of the side rails, and wherein the ends of the top and bottom rails abut inner surfaces of the outside walls at the corresponding ends of the side rails when the support frame is assembled.

7. A rolling shutter assembly as defined in claim 1, wherein the bottom wall defining the opening extends outwardly from the structure beyond the opening, wherein the side rails are hollow tubes, and wherein the bottom rail comprises a flat plate having at least one upwardly extending flange at each end extending upwardly into the end of a corresponding one of the side rails to connect the plate to the side rails.

8. A rolling shutter assembly as defined in claim 1, wherein the support frame comprises a lever arm connected to and extending between the side rails of the support frame at a height proximate the bottom of the shutter housing, the assembly comprising:

a storm bar header connected to the frame at the height of the lever arm and disposed on the opposite side of the side tracks as the frame and the opening; and a storm bar having one end connected to the storm bar header and the opposite end connected to the bottom wall.

9. A rolling shutter assembly as defined in claim 8, wherein the side rails and the lever arm are hollow tubes, wherein each side rail has an opening through an inner wall of the side rail at the location where the end of the lever arm abuts the side rail, and wherein the support frame comprises a pair of unitizing inserts each inserted into an end of the lever arm and into the opening through the inner wall of the corresponding side rail.

10. A method for mounting a rolling shutter assembly to support structure surrounding an opening of a building, the rolling shutter assembly providing hurricane protection for the opening during a hurricane, wherein the opening is defined by a support structure having a top wall, a bottom wall and oppositely disposed side walls, wherein the assembly comprises a shutter housing, a shutter support member rotatably disposed within the shutter housing, a shutter coupled to the shutter support member, the shutter comprising a plurality of individual slats and a plurality of hinges interconnecting the slats, a pair of side tracks, and a support frame having a top rail, a bottom rail, a pair of oppositely disposed side rails connected to the top rail and the bottom rail to form the support frame with a corner defined at each connection between an end of one of the side rails and a corresponding end of one of the top rail and the bottom rail, and a plurality of structural support members each disposed at one of the corners of the support frame and attached to the side rail and to the top rail or the bottom rail to which the side rail is connected at the corresponding corner to transfer torsional loads on the side rails to the top rail and the bottom rail, the method comprising:

mounting the support frame to the support structure with the top rail anchored to the top wall with a first plurality of fasteners extending through the top rail and into the top wall, the bottom rail anchored to the bottom wall with a second plurality of fasteners extending through the top rail and into the top wall, and the side rails disposed proximate the corresponding side walls and not secured to the side walls with fasteners extending through the side rails and into the side walls so that the side rails can deflect inward toward each other and twist relative to the side walls during loading on the shutter caused by the hurricane without causing loads on the side walls;

mounting each of the side tracks to a corresponding one of the side rails of the support frame; and mounting the shutter housing proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks with the side tracks engaging the ends of the slats to retain the ends of the slats in the side tracks such that the side tracks deflect inward toward each other and twist relative to the side walls when the shutter is in the unrolled position and the loading caused by the hurricane is applied to the shutter and the side tracks, wherein the side rails deflect inward toward each other and twist relative to the side walls and do not apply twisting and torsion loads to the side walls when loads are applied to the side rails by the side tracks when the shutter is in the unrolled position and the loading caused by the hurricane is applied to the shutter and the side tracks and causes the side tracks to deflect inward toward each other and twist relative to the side walls, and wherein the loading caused by the hurricane is transferred by the structural support members from the side rails to the top and bottom rails and the top and bottom walls.

11. A method as defined in claim 10, wherein one of the side walls defining the opening is a mullion, the method comprising anchoring one of the side rails of the support frame to the mullion.

12. A method as defined in claim 10, wherein the opening has a mullion extending between and connected to the top wall and the bottom wall defining the opening, wherein the support frame comprises an intermediate vertical rail extending between and connected to the top rail and the bottom rail and positioned to align with the mullion when the support frame is attached to the walls, the method comprising:

anchoring the intermediate vertical rail to the mullion; and anchoring one of the side tracks of the rolling shutter assembly to the intermediate vertical rail.

13. A method as defined in claim 10, wherein the support frame comprises a lever arm connected to and extending between the side rails of the support frame at a height proximate the bottom of the shutter housing, the method comprising:

connecting a storm bar header to the frame at the height of the lever arm with the storm bar header being disposed on the opposite side of the side tracks as the frame and the opening; and connecting one end of a storm bar to the storm bar header and the opposite end of the storm bar to the bottom wall.

14. A method as defined in claim 10, wherein the side tracks are mounted to the side rails before the shutter housing is mounted proximate the top ends of the side tracks.

15. A method as defined in claim 10, wherein the shutter housing is mounted proximate the top ends of the side tracks before the side tracks are mounted to the side rails.

16. In a rolling shutter assembly for covering an opening of a structure defined by a support structure having a top wall, a bottom wall and oppositely disposed side walls, the rolling shutter assembly providing hurricane protection for the opening during a hurricane, the assembly having a shutter housing, a shutter support member rotatably disposed within the shutter housing, a shutter coupled to the shutter support member, the shutter comprising a plurality of individual slats and a plurality of hinges interconnecting the slats, and a pair of side tracks, and wherein the shutter housing is mounted proximate the top ends of the side tracks such that the shutter rolls between a rolled position wherein the shutter is rolled onto the shutter support member and an unrolled position wherein the shutter covers the opening and the ends of the slats are disposed within the channels of the corresponding side tracks with the side tracks engaging the ends of the slats to retain the ends of the slats in the side tracks such that the side tracks deflect inward toward each other and twist relative to the side walls when the shutter is in the unrolled position and the loading caused by the hurricane is applied to the shutter and the side tracks, the improvement comprising:

a support frame having a top rail, a bottom rail, a pair of oppositely disposed side rails connected to the top rail and the bottom rail to form the support frame with a corner defined at each connection between an end of one of the side rails and a corresponding end of one of the top rail and the bottom rail, and a plurality of structural support members each disposed at one of the corners of the support frame and attached to the side rail and to the top rail or the bottom rail to which the side rail is connected at the corresponding corner to transfer torsional loads on the side rails to the top rail and the bottom rail, wherein the side tracks are each mounted to a corresponding one of the side rails of the support frame, wherein the support frame is mounted to the walls of the support structure defining the opening with the top rail anchored to the top wall with a first plurality of fasteners extending through the top rail and into the top wall, the bottom rail anchored to the bottom wall with a second plurality of fasteners extending through the bottom rail and into the bottom wall, and the side rails disposed proximate the corresponding side walls and not secured to the side walls by fasteners extending through the side rails and into the side walls so that the side rails deflect inward toward each other and twist relative to the side walls during loading on the shutter caused by the hurricane without causing loads on the side walls, wherein the side rails deflect inward toward each other and twist relative to the side walls and do not apply twisting and torsion loads to the side walls when loads are applied to the side rails by the side tracks when the shutter is in the unrolled position and the loading caused by the hurricane is applied to the shutter and the side tracks and causes the side tracks to deflect inward toward each other and twist relative to the side walls, and wherein the loading caused by the hurricane is transferred by the structural support members from the side rails to the top and bottom rails and the top and bottom walls.

17. A rolling shutter assembly as defined in claim 16, wherein the side rails of the support frame are against the corresponding side walls of the support structure defining the opening.

18. A rolling shutter assembly as defined in claim 16, wherein one of the side walls defining the opening is a mullion, and wherein one of the side rails of the support frame is disposed against the mullion.

19. A rolling shutter assembly as defined in claim 16, wherein the opening has a mullion extending between and connected to the top wall and the bottom wall defining the opening, wherein the support frame comprises an intermediate vertical rail extending between and connected to the top rail and the bottom rail and positioned to align with the mullion when the support frame is attached to the walls, and wherein the intermediate vertical rail is anchored to the mullion and one of the side tracks of the rolling shutter assembly is anchored to the intermediate vertical rail.

20. A rolling shutter assembly as defined in claim 16, wherein the top and the side rails are hollow tubes, wherein the ends of the top and the side rails are beveled such that the adjoining rails form a mitered corner, and wherein the support frame comprises a plurality of L-shaped unitizing inserts each disposed at one of the corners of the support frame with one leg extending into the end of each of the adjoining rails, and wherein each leg of the L-shaped unitizing insert is connected to the corresponding end of one of the rails to secure the ends of the adjoining rails forming the corner.

21. A rolling shutter assembly as defined in claim 16, wherein the top, the bottom and the side rails are hollow tubes having front, rear, inside and outside walls, wherein inside and rear walls of the side rails do not extend to the ends of the side rails, and wherein the ends of the top and bottom rails abut inner surfaces of the outside walls at the corresponding ends of the side rails when the support frame is assembled.

22. A rolling shutter assembly as defined in claim 16, wherein the bottom wall defining the opening extends outwardly from the structure beyond the opening, wherein the side rails are hollow tubes, and wherein the bottom rail comprises a flat plate having at least one upwardly extending flange at each end extending upwardly into the end of a corresponding one of the side rails to connect the plate to the side rails.

23. A rolling shutter assembly as defined in claim 16, wherein the support frame comprises a lever arm connected to and extending between the side rails of the support frame at a height proximate the bottom of the shutter housing, the assembly comprising:

a storm bar header connected to the frame at the height of the lever arm and disposed on the opposite side of the side tracks as the frame and the opening; and a storm bar having one end connected to the storm bar header and the opposite end connected to the bottom wall.

24. A rolling shutter assembly as defined in claim 23, wherein the side rails and the lever arm are hollow tubes, wherein each side rail has an opening through an inner wall of the side rail at the location where the end of the lever arm abuts the side rail, and wherein the support frame comprises a pair of unitizing inserts each inserted into an end of the lever arm and into the opening through the inner wall of the corresponding side rail.

* * * * *